United States Patent [19]

Chai

[11] Patent Number: 4,814,782

[45] Date of Patent: Mar. 21, 1989

[54] SINGLE TURN FERRITE ROD ANTENNA AND METHOD

[75] Inventor: Teo C. Chai, Singapore, Singapore

[73] Assignee: Motorola, Inc., Schaumburg, Ill.

[21] Appl. No.: 219,892

[22] Filed: Jul. 14, 1988

Related U.S. Application Data

[63] Continuation of Ser. No. 940,707, Dec. 11, 1986.

[51] Int. Cl.[4] ..... H01A 7/08

[52] U.S. Cl. ..... 343/787; 343/788

[58] Field of Search ..... 343/702, 726, 787, 788; 361/394, 395, 399, 406

[56] References Cited

U.S. PATENT DOCUMENTS 4,123,756 10/1978 Nagatz et al. ..... 343/702

FOREIGN PATENT DOCUMENTS 0030803 2/1986 Japan .

*Primary Examiner*—William L. Sikes

*Assistant Examiner*—Doris J. Johnson

*Attorney, Agent, or Firm*—Vincent B. Ingrassia; Anthony J. Sarli, Jr.; Donald B. Southard

[57] ABSTRACT

An antenna having provision for mounting to a printed circuit board and method for making the antenna is described. The antenna includes a generally elongate, magnetically permeable core having a major axis and an insulating substrate affixed along an axis parallel to the major axis. The insulating substrate has a plurality of opposed pairs of spaced conductive runners positioned at generally regular intervals along the substrate normal to the major axis. A plurality of discrete capacitors are and perpendicular to secured between the opposed pairs of conductive runners. An electrically conductive split sleeve substantially surrounds the core and has pairs of opposed tabs on the edge portions in electrical connection with the opposed pairs of conductive runners. The sleeve further includes integral mounting tabs for securing the antenna assembly to the printed circuit board to establish electrical connection to the antenna without the use of wire leads.

11 Claims, 2 Drawing Sheets

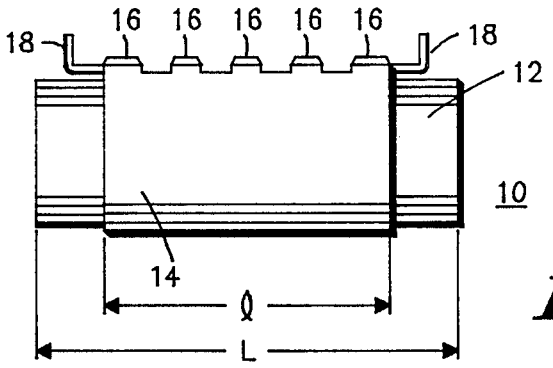
FIG. 1A
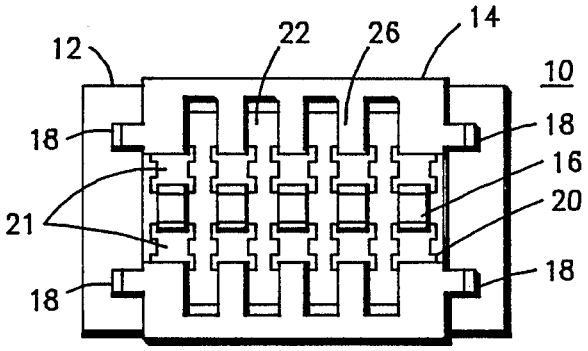
FIG. 1B
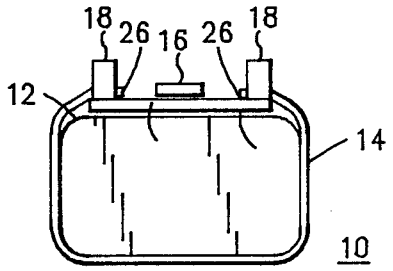
FIG. 1C
FIG. 2
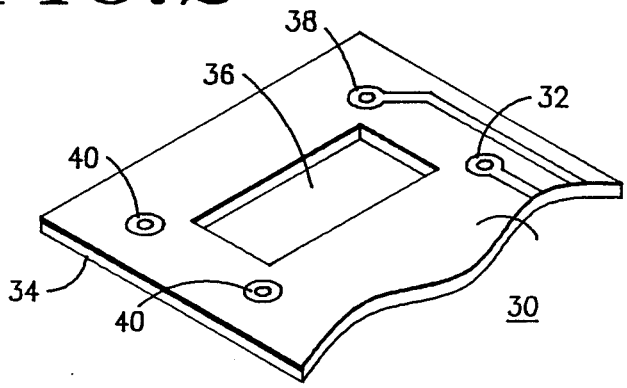

SINGLE TURN FERRITE ROD ANTENNA AND METHOD

This is a continuation of application Ser. No. 940,707, filed Dec. 11, 1986.

BACKGROUND OF THE INVENTION

The present invention relates, in general, to a single turn ferrite rod antenna and method. More particularly, the present invention relates to an antenna and method resulting in a high "Q", high sensitivity antenna suitable for use in conjunction with miniaturized receivers.

Requirements for decreased size of paging and radio receiver packages have necessitated simplification and down-sizing of antenna elements to meet manufacturing and size constraints. However, the antenna must, nevertheless, provide a sufficiently high "Q" (low loss) while simultaneously exhibiting sufficient radiated signal sensitivity. Existing technologies have been unsatisfactory in meeting these constraints.

U.S. Pat. No. 3,267,478 issued to Schiefer on Aug. 16, 1966 for a tunable ferromagnetic rod loop antenna describes an antenna comprising a cylindrical core surrounded by a sleeve of electrically conductive material. A gap is shown running the entire length of the sleeve and has a plurality of capacitors, equidistantly spaced, distributed throughout its length. A coupling winding surrounds at least a portion of the core and includes a pair of wires for coupling the antenna assembly to the receiver. Normally symmetrical conductors or coaxial conductors are used to establish electrical connection to the receiver input stage. The antenna shown provides no means for ready mounting to a printed circuit board. As a consequence, such an antenna would not be suitable for use with today's more compact mounting and advantageous circuit interconnection techniques.

In like manner, U.S. Pat. No. 3,594,805 issued to Chardin on July 20, 1971 for a ferrite rod antenna with a longitudinally split sleeve, describes an antenna in which the resonant frequency may be adjusted by varying the inductance of a first split sleeve. The opposite edges of the longitudinal split are connected by a plurality cf capacitors uniformly distributed over the length of the sleeve. The first sleeve additionally includes a longitudinal slot approximately one-third of the length of the rod. A second split sleeve is positioned over the first sleeve to adjust the inductance of the assembly by masking portions of the longitudinal slot. No adequate means are disclosed for mounting the antenna to a printed circuit board, rather the same prior art provision for wire leads forming the electrical connections between the circuit and the antenna are described.

Additional antenna construction techniques include that disclosed in U.S. Pat. No. 3,946,397 issued to Irwin on Mar. 23, 1976 for antenna arrangement having an inductor combined with integral series resonating circuits. The antenna disclosed includes a spiral inductor or coil which is divided into a number of segments interconnected by individual capacitive elements to form a number of series-resonant circuits. While an effective antenna technique, it would be highly desirable to provide an antenna exhibiting a high "Q" and high sensitivity which is simpler to implement and may be more readily connected to a printed circuit board.

It would therefore be highly desirable to provide an expedient structure for and method of mounting and electrically connecting an antenna to a printed circuit board which does not require the use of wire leads and in which any tuning adjustment would be located remotely from the antenna structure itself.

SUMMARY OF THE INVENTION

It is therefore an object of the present invention to provide an improved single turn ferrite rod antenna structure and method.

It is further an object of the present invention to provide an improved single turn ferrite rod antenna and method which is readily and inexpensively implemented.

It is still further an object of the present invention to provide an improved single turn ferrite rod antenna structure and method which provides a high "Q", high sensitivity antenna suitable for use in conjunction with miniaturized radio and paging receivers.

It is still further an object of the present invention to provide an improved single turn ferrite rod antenna structure and method which allows for ready assembly to a printed circuit board and electrical contact without wire leads.

It is still further an object of the present invention to provide an improved single turn ferrite rod antenna structure and method which allows for remote location of an antenna trimmer and matching capacitors thereby facilitating manufacturing, assembly and calibration operations.

The foregoing and other objects are achieved in the present invention wherein there is provided an antenna comprising a generally elongate, magnetically permeable core having a major axis. An insulating substrate is affixed along an axis parallel to the major axis of the core. A plurality of charge storage devices, each having first and second electrical contacts, is secured to the substrate. An electrically conductive split sleeve surrounding the core has edge portions which include a plurality of pairs of opposed tabs in electrical connection with the first and second electrical contacts of the corresponding ones of the plurality of charge storage devices. The conductive sleeve further includes integral mounting tabs for mounting and providing electrical contact for the assembled antenna to a printed circuit board.

In accordance with a method of the present invention, a method for providing an antenna for a radio receiver includes the steps of furnishing an insulating substrate. The insulating substrate is affixed to a generally elongate, magnetically permeable core and aligned along an axis parallel to the major axis of the core. A plurality of charge storage devices are secured to the substrate along the parallel axis. Each of the charge storage devices includes first and second electrical contacts. The core is surrounded with an electrically conductive sleeve having first and second edge portions with pairs of opposed tabs electrically connected to the first and second electrical contacts of corresponding charge storage devices. The antenna may be directly mounted to a printed circuit board by the integral mounting tabs of the conductive sleeve.

BRIEF DESCRIPTION OF THE DRAWINGS

The above mentioned and other features and objects of the present invention and the manner of attaining them will become more apparent and the invention itself will be best understood by reference to the following description of an embodiment of the invention taken in conjunction with the accompanying drawings, wherein:

FIG. 1 presents a side view of an embodiment of a single turn ferrite rod antenna in accordance with the present invention illustrating the single turn sleeve, distributed discrete capacitors, and integral mounting and contact tabs.

FIG. 2 presents a top surface plan view of an embodiment of a single turn ferrite rod antenna in accordance with the present invention illustrating the single turn sleeve, distributed discrete capacitors, and integral mounting and contact tabs.

FIG. 5 is a simplified electrical schematic diagram of an antenna in accordance with the present invention.

FIG. 6 is a graphic plot of "Q" vs. frequency for variations of the ratio of the length of the single turn sleeve to the length of tee ferrite rod as shown in FIG. 1.

DESCRIPTION OF A PREFERRED EMBODIMENT

Figure 3:
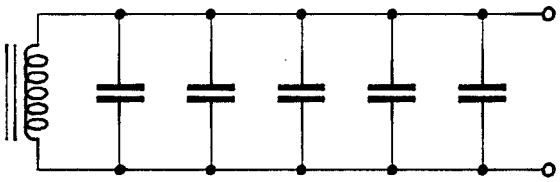
FIG. 3 presents an end elevational view of an embodiment of a single turn ferrite rod antenna in accordance with the present invention illustrating the single turn sleeve, distributed discrete capacitors, and integral mounting and contact tabs.

With reference to FIGS. 1, 2 and 3 a single turn ferrite rod antenna 10, in accordance with the present invention, is shown. Single turn ferrite rod antenna 10 comprises ferrite rod 12 having a surrounding single turn conductive sleeve 14. As illustrated in FIG. 1, ferrite rod 12 includes a major axis of length "L" while single turn sleeve 14 has a lesser length "1" along a parallel axis. Single turn ferrite rod antenna 10 may have a generally rectangular cross section as shown more clearly in FIG. 3 or any other suitable geometric configuration. Single turn sleeve 14 may be preferably made of copper or beryllium copper.

Single turn ferrite rod antenna 10 further includes a number of distributed capacitors 16, which function as charge storage devices, affixed to printed circuit board 20. Distributed capacitors 16 may be discrete fixed chip capacitors of generally equal capacitance aligned along an axis parallel to the major axis of single turn ferrite rod antenna 10 and uniformly distributed along length 1. As may be best seen in FIG. 2, printed circuit board 20 includes corresponding pairs of spaced apart conductive runners 21 on chip mounting surface 22 to which distributed capacitors 16 may be electrically connected by soldering. To enhance the understanding, capacitors 16 have been cross hatched to show greater contrast with runners 21. Printed circuit board 20 further includes an undersurface 24 which may be glued or otherwise secured to ferrite rod 12. Single turn sleeve 14 further includes a number of pairs of opposed digitated solder tabs 26 which adjoin printed circuit board 20 at chip mounting surface 22. In this manner, the preformed single turn sleeve 14 may be electrically connected by soldering to the conductive runners 21 on chip mounting surface 22 of printed circuit board 20 for establishing electrical contact between pairs of opposed digitated tabs and corresponding capacitors 16.

FIG. 3 shows an end elevational view of the assembled single turn ferrite rod antenna in which printed circuit board 20 is attached to a substantially rectangular cross section ferrite rod 12 in contact with undersurface 24 of printed circuit board 20. In this view, chip mounting surface 22 is shown, but conductive runners 21 are not. Digitated solder tabs 26 and distributed capacitors 16 may be clearly seen. Mounting and contact tabs 18 are clearly shown extending outwardly from chip surface 22.

Figure 4:
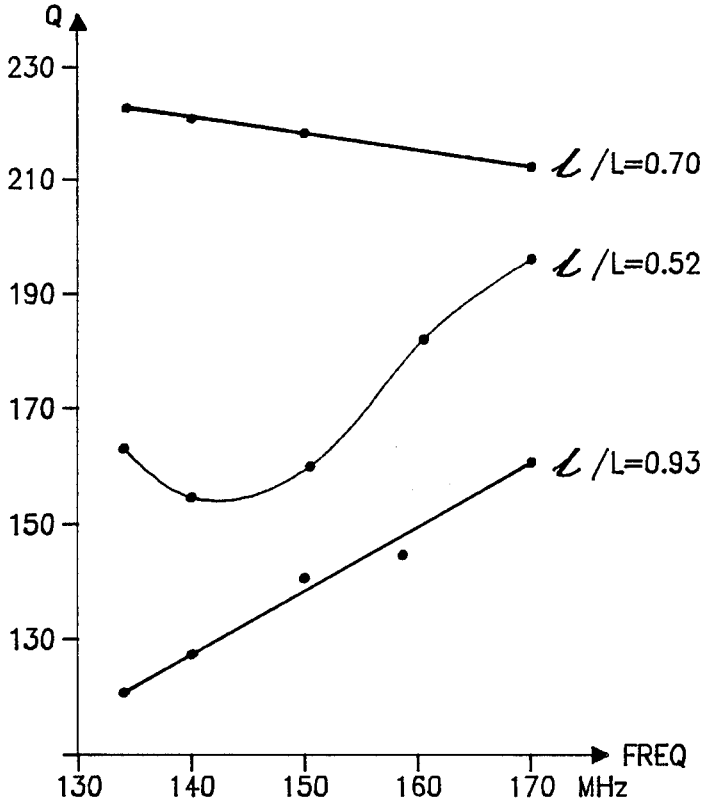
FIG. 4 illustrates a partially cut-away perspective view of a portion of a printed circuit board for mounting of the antenna of FIGS. 1–3 and illustrating electrical contact of the antenna by means of printed circuit board runners.

Referring additionally to FIG. 4, a circuit board 30 is shown for mounting and establishing electrical connection to single turn ferrite rod antenna 10. As shown in the preceding figures, single turn ferrite rod antenna 10 incorporates a number of mounting and contact tabs 18 integral with single turn sleeve 14 and extending outwardly from surface 22. As will be described later, mounting and contact tabs 18 serve to physically retain single turn ferrite rod antenna 10 to a printed circuit board while simultaneously providing electrical contact between the antenna 10 and the input stage of a radio or paging receiver. In addition, other circuitry, such as additional trimmer circuitry, can be interconnected on the board without affecting the antenna. This structure not only provides a rigid support for the antenna, but lead wires are not necessary for establishing electrical connection between single turn ferrite rod antenna 15 and subsequent circuitry.

As illustrated, circuit board 30 includes an interconnect surface 32 and opposite upper surface 34. Aperture 36 communicates between interconnect surface 32 and upper surface 34 of circuit board 30 at a point at which single turn ferrite rod antenna 10 may be mounted. This aperture provides clearance for the components mounted on printed circuit board 20. In particular, aperture 36 allows for the protrusion of distributed chip capacitors 16. Single turn ferrite rod antenna 10 is mounted to circuit board 30 by insertion of mounting and contact tabs 18 through slots extending from upper surface 34 through to interconnect surface 32 shown at runners 38 and mounting points 40. Thus, when so positioned, one would observe through aperture 36 a view of antenna structure 10 similar to that shown in FIG 2. Mounting and contact tabs 18 extending through the slots of runners 38 and mounting points 40 may be then soldered in place to retain single turn ferrite rod antenna securely to circuit board 30 as well as to establish electrical contact to subsequent circuitry.

With reference to FIGS. 5 and 6 an equivalent electrical schematic for single turn ferrite rod antenna 10 is shown as well as a graphic plot of "Q" vs. frequency in Megahertz for the antenna structure. Thus, it may be seen that the physical implementation of the antenna structure shown in FIG. 2 corresponds well with the electrical schematic shown in FIG. 5. The distributed capacitance of single turn ferrite rod antenna 10 is chosen such that it has a value which resonates with the inductance of single turn sleeve 14 at, or about, the mid-point of the operating wave length of the antenna's intended use. For an application in the range of VHF 138–174 MHz, optimum performance has been achieved by using 5 capacitors mounted to a 0.6 mm thick printed circuit board 20. The length "L" of ferrite rod 12 is approximately 20 mm while the length "1" of single turn sleeve 14 is approximately 14 mm. Ferrite rod 12 has a cross sectional width of approximately 7 mm. FIG. 6 illustrates the effect on "Q" and frequency for various ratios of single turn sleeve length "1" to ferrite rod 12 length "L".

Single turn ferrite rod antenna 10 differs from a standard approach to radio pager antenna design which uses either a conventional multi turn "copper wire" ferrite rod or wire air loop. The size efficiency of such a prior art system is insufficient to meet the requirements of current receiver packaging technology which may be limited to approximately 40.9 $cm^3$ and still provide the required radiated signal sensitivity.

Prior art technology has generally required that a trimmer capacitor be mounted adjacent the distributed capacitors of a standard antenna thereby requiring that any adjustments be made to the trimmer from the underside of the printed circuit board 20. This is opposite to the adjustment procedure for slug-tuned coils which are normally used in conjunction with an antenna and which are normally mounted on the component side of the printed circuit board. Thus, use of prior art technology would necessitate an extra processing step in calibration of the antenna. In addition, prior art antenna designs have uniformly required the use of lead wires from the antenna itself to the circuit board containing the receiver further necessitating additional assembly and handling steps.

By use of single turn ferrite rod antenna 10 of the present invention, a trimmer capacitor may be located remotely from the antenna itself, but conveniently on the printed circuit board to which the antenna assembly of the present invention is mounted. Also, the antenna of the present invention may be mounted and electrically connected to the receiver input stage by means of mounting and contact tabs 18 contacting conductive paths on a circuit board. Thus, only a single, one-step mounting process for a single turn ferrite rod antenna 10 is required and all adjustments to the antenna trimmer and/or slug tuned coils may be made from the same side of the printed circuit board.

What has been provided therefore is an improved single turn ferrite rod antenna and method which is readily and inexpensively implemented. The single turn ferrite rod antenna and method of the present invention provides a high "Q", high radiated signal sensitivity antenna suitable for use in conjunction with miniaturized radio and paging receivers. The antenna structure allows for ready assembly to a printed circuit board for establishing electrical contact without the us of wire connectors. The antenna and method of the present invention further allow for remote location of an antenna trimmer or matching capacitors thereby facilitating manufacturing, assembly and calibration operations.

While there have been described above the principles of the invention in conjunction with specific apparatus, it is to be clearly understood that this description is made only by way of the example and not as a limitation to the scope of the invention.

What is claimed is:

1. An antenna having provision for mounting to a printed circuit board, said antenna comprising:

a generally elongate, magnetically permeable core having a major axis;

an insulating substrate being affixed to said core along an axis parallel to said major axis, said insulating substrate having a plurality of opposed pairs of spaced conductive runners positioned at generally regular intervals along said substrate normal to said major axis;

a plurality of charge storage devices secured between said opposed pairs of conductive runners; and an electrically conductive split sleeve positioned surrounding said core, said sleeve having first and second edge portions with a corresponding plurality of pairs of opposed tabs in electrical connection with said opposed pairs of conductive runners opposite said charge storage devices, said sleeve further including integral mounting tabs for mounting and providing electrical contact for the antenna to the printed circuit board.

2. The antenna of claim 1 wherein said core is a ferrite rod.

3. The antenna of claim 2 wherein said ferrite rod has a substantially rectangular cross-section normal to said major axis.

4. The antenna of claim 1 wherein said charge storage devices are fixed value, discrete capacitors.

5. The antenna of claim 1 wherein said split sleeve comprises a generally elongate band.

6. The antenna of claim 6 wherein said band comprises a formed copper sheet.

7. The antenna of claim 1 wherein said insulating board is affixed to said core using an adhesive.

8. A method for providing an antenna for assembly to a printed circuit board comprising the steps of:

furnishing an insulating substrate, the substrate having a plurality of opposed pairs of parallel spaced conductive runners positioned at generally regular intervals along the length of said substrate;

affixing said insulating substrate to a generally elongate, magnetically permeable core along a major axis;

securing a plurality of charge storage devices between said opposed pairs of conductive runners;

surrounding said core with an electrically conductive split sleeve having first and second edge portions with pairs of opposed tabs, said sleeve also including integral mounting tabs; and electrically coupling said pairs of opposed tabs on said first and second edge portions to said conductive runners opposite said charge storage devices.

9. The method of claim 8 wherein said step of securing is carried out by means of soldering said charge storage devices to said conductive runners.

10. The method of claim 8 wherein said step of affixing is carried out by means of an adhesive.

11. The method of claim 8 wherein said step of electrically coupling is carried out by means of soldering the pairs of opposed tabs of said first and second edge portions to said conductive runners.

* * * * *